US006186209B1

(12) United States Patent
Lanthier

(10) Patent No.: US 6,186,209 B1
(45) **Date of Patent: *Feb. 13, 2001**

(54) IMPERMEABLE CORRUGATOR BELT FOR APPLICATION ON AIR BEARING PRESSURE ZONES OF A CORRUGATOR MACHINE

(75) Inventor: Joseph D. Lanthier, Cohoes, NY (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/739,429

(22) Filed: Oct. 29, 1996

(51) Int. Cl.[7] ..... B31F 1/20
(52) U.S. Cl. ..... 156/470
(58) Field of Search ..... 162/348, DIG. 1, 162/232, 359, 290, 306, 358.2, 358.4, 360.2, 901; 474/206, 207; 137/383 A, 409, 412, 413, 425 A; 34/123, 116; 428/272, 224, 397, 293, 294, 365, 371, 252, 265

(56) References Cited

U.S. PATENT DOCUMENTS

| | | | | |
|---|---|---|---|---|
| 4,395,308 | * | 7/1983 | Dawes | 162/232 |
| 4,403,632 | * | 9/1983 | Romanski et al. | 139/383 A |
| 4,662,994 | * | 5/1987 | Lord | 162/348 |
| 4,675,229 | * | 6/1987 | Westhead | 428/222 |
| 5,050,646 | * | 9/1991 | Fry | 139/383 A |
| 5,115,582 | * | 5/1992 | Westhead | 34/123 |
| 5,298,124 | * | 3/1994 | Eklund et al. | 162/306 |

* cited by examiner

*Primary Examiner*—Donna C. Wortman
(74) *Attorney, Agent, or Firm*—Pitney, Hardin, Kipp & Szuch LLP

(57) ABSTRACT

An impermeable corrugator belt for a corrugator machine includes a multi-layer base fabric having a layer of a polymeric resin material on one of its two sides. When arranged in the form of an endless loop, the side having the layer of polymeric resin material is on the inside thereof. The polymeric resin material renders the corrugator belt impermeable, and therefore suitable for use on a corrugator machine having air-bearing pressure zones. Instead of a multi-layer base fabric, a spiral coil carrier may be used as the base of the corrugator belt.

10 Claims, 2 Drawing Sheets

IMPERMEABLE CORRUGATOR BELT FOR APPLICATION ON AIR BEARING PRESSURE ZONES OF A CORRUGATOR MACHINE

BACKGROUND OF THE INVENTION

1. Field of the Invention

The present invention relates to corrugated paper board manufacture and, more specifically, to corrugator belts for the corrugator machines used to manufacture that variety of paper board.

2. Description of the Prior Art

The manufacture of corrugated paper board, or box board, on corrugator machines is well-known in the art. On such machines, corrugator belts pull a web of corrugated board first through a heating zone, where an adhesive used to bond layers of the web together is dried or cured, and then through a cooling zone. Frictional forces between the corrugator belt, specifically the so-called board side thereof, and the web are primarily responsible for pulling the latter through the machine.

The corrugator belts employed to pull the web of corrugated board through the corrugator machine should be strong and durable, and should have good dimensional stability under the conditions of tension and high temperature encountered on the machine. The belts must also be comparatively flexible in the longitudinal, or machine, direction, while having sufficient rigidity in the cross-machine direction to facilitate the guiding of the belts along their endless paths. Traditionally, it has also been desirable for the belts to have sufficient porosity for vapor to pass freely therethrough, while being sufficiently incompatible with moisture to avoid the adsorption of condensed vapor which might otherwise rewet the surfaces of the corrugated product.

As implied in the preceding paragraph, a corrugator belt takes the form of an endless loop when installed on a corrugator machine. In such form, the corrugator belt has a board-side, as previously mentioned, and a back side, which is on the inside of the endless loop. Frictional forces between the surface of the back side and the drive rolls of the corrugator machine move the corrugator belt, and frictional forces between the surface of the board side and the web of corrugated board pull the web through the machine.

Corrugator belts are generally flat-woven, multi-layered fabrics, each of which is trimmed in the lengthwise and widthwise directions to a length and width appropriate for the corrugator machine on which it is to be installed. The ends of the fabrics are provided with seaming means, so that they may be joined to one another with a lacing cable when the corrugator belt is being installed on a corrugator machine.

In a typical corrugator machine, the heating zone comprises a series of hot plates across which the web of corrugated board is pulled by the corrugator belt. A plurality of weighted rollers within the endless loop formed by the corrugator belt press the corrugator belt toward the hot plates, so that the corrugator belt may pull the web across the hot plates under a selected amount of pressure. The weighted rollers ensure that the web will be firmly pressed against the hot plates, and that frictional forces between the corrugator belt and the web will be sufficiently large for the belt to pull the web.

In a new generation of corrugator machines, however, weighted rollers are being eliminated in favor of air impingement or air bearings, in which a high-velocity flow of air directed against the back side of the corrugator belt toward the hot plates forces the belt towards the hot plates. Corrugator belts currently available have permeabilities in the range from 3 to 20 cubic feet of air per square foot per minute under 0.5 inch water pressure. While this is quite low, it has proven to be large enough to allow enough air from the air bearings to pass through the corrugator belt to lift the belt from the web of corrugated board. This leads to slippage between belt and web, and to poor contact between web and hot plates, the latter of which ultimately leads to poor, non-uniform bonding in the laminated corrugated board product.

Clearly, a corrugator machine of this new type requires a totally sealed, impermeable corrugator belt. The present invention is such a belt.

SUMMARY OF THE INVENTION

Accordingly, the present invention is an impermeable corrugator belt for a corrugator machine which comprises a multi-layer base fabric having two sides, and a layer of a polymeric resin material on one of those two sides. The layer of polymeric resin material is impermeable and seals the corrugator belt to prevent the passage of air therethrough.

The multi-layer base fabric has a plurality of layers of weft yarns and a plurality of systems of warp yarns, each of the systems weaving between the weft yarns of two of the plurality of layers. All of the plurality of layers of weft yarns are joined together by the systems of warp yarns.

When the impermeable corrugator belt is placed into endless form on a corrugator machine, the layer of polymeric resin material is on the inside of the endless-loop form and prevents forced air from air bearings or the like from penetrating the belt.

While the impermeable corrugator belt of the present invention has been described as comprising a multi-layer base fabric, those of ordinary skill in the art will readily appreciate that the present invention may also be practiced using a base in the form of a spiral coil carrier instead of a woven structure. Spiral coil carriers are shown in U.S. Pat. Nos. 4,395,308; 4,662,994; and 4,675,229, the teachings of all three of which are incorporated herein by reference. Spiral coil carriers are well-known to those of ordinary skill in the arts of papermaker's dryer fabrics and corrugator belts, and include a plurality of hinge yarns, all of the hinge yarns extending in a common direction, and a plurality of spiral coils disposed in a common plane in a side-by-side relationship, each of the coils extending in the common direction. Adjacent coils of the spirals are intermeshed and held together in intermeshing relationship by at least one of the hinge yarns. The endless spiral coil carrier thereby obtained has two sides. As above, a layer of a polymeric resin material is on one of those two sides; it is impermeable and seals the corrugator belt to prevent the passage of air therethrough. When the impermeable corrugator belt having a base in the form of an endless spiral coil carrier is placed on a corrugator machine, the layer of polymeric resin material is on the inside of the endless-loop form and prevents forced air from air bearings or the like from penetrating the belt.

The present invention will now be described in more complete detail with frequent reference being made to the figures identified as follows.

DETAILED DESCRIPTION OF THE PREFERRED EMBODIMENTS

Figure 1:
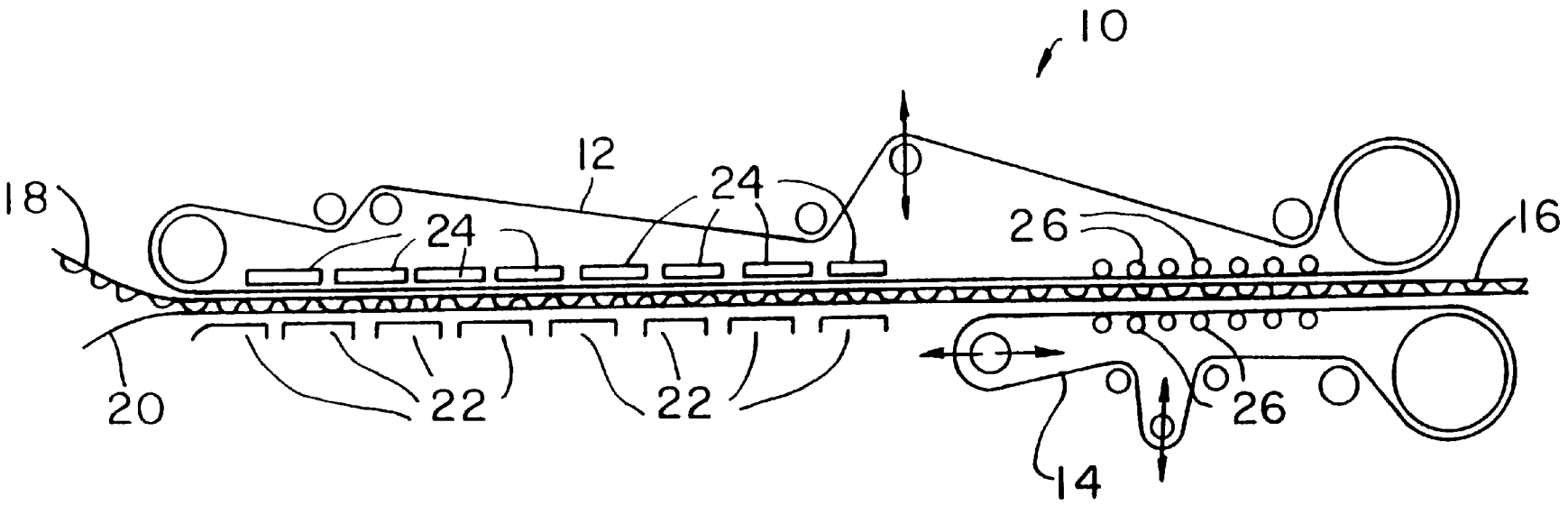
FIG. 1 is a schematic view of a portion of a corrugator machine.

Referring to FIG. 1, therein is shown a portion of a corrugator machine 10 having an upper corrugator belt 12 and a lower corrugator belt 14 which together pull a corrugated paper product 16 therethrough. The corrugated paper product 16 includes a corrugated layer 18 and an uncorrugated layer 20, which are to be joined to one another in the corrugator machine 10 by means of a suitable adhesive. The corrugated layer 18 and the uncorrugated layer 20 are brought together at one end of the machine 10 and are pulled by the upper corrugator belt 12 across a series of hot plates 22 to dry and/or to cure the adhesive which bonds the paper layers together.

The corrugator machine 10 includes a plurality of air bearings 24 from which high-velocity air flows are directed against the inside of the upper corrugator belt 12 toward the hot plates 22. The air bearings 24 thereby apply pressure from within the endless loop formed by upper corrugator belt 12, so that the upper corrugator belt 12 may pull the corrugated paper product 16 across the series of hot plates 22 under a selected amount of pressure at the same time as it pushes the corrugated paper product 16 against the series of hot plates 22. It should be understood by the reader that the upper corrugator belt 12, the corrugated paper product 16 and the series of hot plates 22 are separated from one another for the sake of clarity in FIG. 1.

After passing over the series of hot plates 22, the upper corrugator belt 12 and the lower corrugator belt 14 together pull the corrugated paper product 16 between them, maintaining the speed of the process operation and cooling the corrugated paper product 16. As may be observed, weighted rollers 26 may be deployed to apply pressure from within the endless loops formed by the upper corrugator belt 12 and the lower corrugator belt 14 toward one another, so that the corrugated paper product 16 may be held therebetween with some suitable degree of firmness.

Upon exit from between the upper corrugator belt 12 and the lower corrugator belt 14, the corrugated paper product 16 is cut and/or stacked as required.

The impermeable corrugator belt of the present invention is designed for use as an upper corrugator belt 12 on a corrugator machine 10 of the variety shown in FIG. 1. A cross-sectional view of an embodiment thereof, taken in the longitudinal or warpwise direction, and showing the weft or filling yarns in cross section, is presented in FIG. 2. Because the embodiment shown is flat-woven, the warp yarns in its base fabric are oriented in the machine direction with respect to the corrugator machine on which it is installed.

Figure 2:
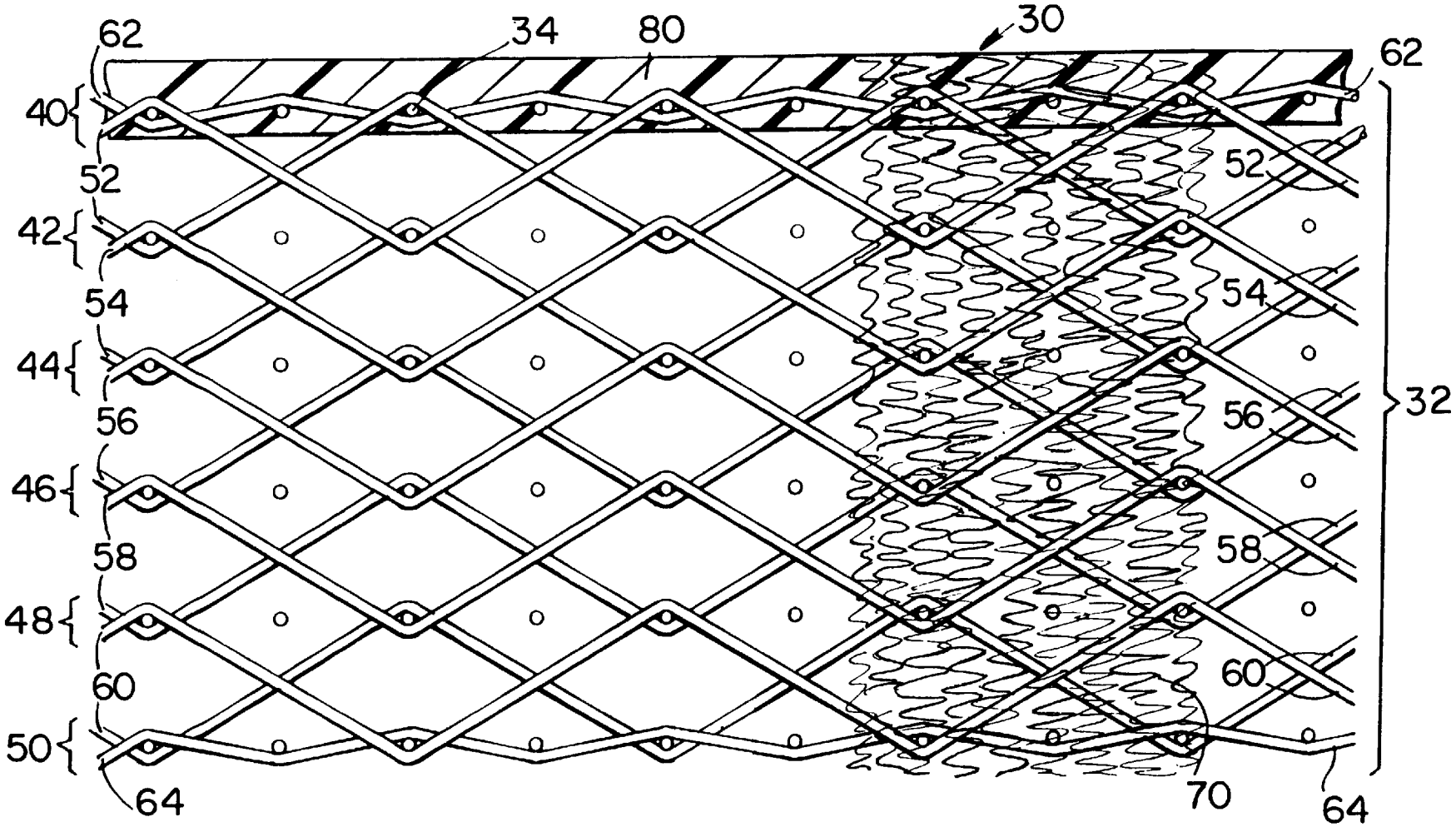
FIG. 2 is a cross-sectional view, taken in the longitudinal or warpwise direction of the impermeable corrugator belt of the present invention.

As depicted in FIG. 2, the impermeable corrugator belt 30 includes a multi-layer base fabric 32 comprising a plurality of layers of weft or filling yarns, each of which layers is connected to those adjacent thereto by a system of warp yarns.

With specific reference to the embodiment illustrated in FIG. 2, the multi-layer base fabric 32 comprises six layers of weft, or filling, yarns 34, wherein the weft, or filling, yarns 34 in each layer are disposed in a vertically stacked relationship with respect to those in other layers.

The first layer 40 and the second layer 42 of weft yarns 34 are joined or woven to each other by a first system of warp yarns 52. In like manner, the second layer 42 and the third layer 44 are woven together by a second system of warp yarns 54; the third layer 44 and the fourth layer 46 are woven together by a third system of warp yarns 56; the fourth layer 46 and the fifth layer 48 are woven together by a fourth system of warp yarns 58; and, finally, the fifth layer 48 and the sixth layer 50 are woven together by a fifth system of warp yarns 60.

Additional warp yarns 62 weave with the weft yarns 34 of the first layer 40 in a plain weave, and, likewise, additional warp yarns 64 weave with the weft yarns 34 of the sixth layer 50, also in a plain weave, to fill out the surfaces of the base fabric 32.

The weave pattern shown in FIG. 2, however, should be understood to be an example of the multi-layer weaves which may be employed in the practice of the present invention and should not be construed as limiting such practice to the specific weave shown. In like manner, the impermeable corrugator belt of the present invention may be manufactured using a base in the form of a spiral coil carrier, as described above, rather than a base like multi-layer base fabric 32.

The base fabric 32 may be woven from warp and filling yarns comprising yarns of any of the varieties used in the manufacture of papermachine clothing and industrial process fabrics. That is to say, the base fabric 32 may include monofilament, plied monofilament, or multifilament yarns of any of the synthetic polymeric resins used by those skilled in the art, such as polyester, polyamide, and polyethylene or polybutylene terephthalate. Spun yarns of natural or synthetic staple fibers may also be included, so long as they are capable of withstanding the temperatures characteristic of corrugator machines. Spun polyester, polyamide or polyaramid yarns are but a few examples.

One or both sides of the base fabric 32 may be needled with a web 70 of staple fiber material in such a manner that the fibers are driven into the structure of the base fabric 32. One or more layers of staple fiber material may be needled into one or both sides of the base fabric 32, and the web 70 may extend partially or completely through the base fabric 32.

The webs of staple fiber material used for this purpose may be of polyester, polypropylene, polyamide or acrylic fibers. For the sake of clarity, the web 70 is included in only a portion of FIG. 2.

Where a spiral coil carrier of the variety described above is used instead of base fabric 32, one or both of its two sides may be needled with a web of staple fiber material in such a manner that the fibers are driven into its structure. One or more layers of staple fiber material may be needled into one or both sides of the spiral coil carrier, and the web may extend partially or completely through the spiral coil carrier.

Referring again to FIG. 2, one side of the base fabric 32 is sealed with a layer 80 of polymeric resin material, which renders the corrugator belt 30 impermeable. In the actual use of the impermeable corrugator belt 30 on a corrugator machine, the layer of polymeric resin material is disposed on the inside of the endless-loop form thereof, which may therefore be properly referred to as the back side of the belt 30, while the other side of the base fabric 32 is the outside of the endless-loop form of the belt 30, which may be properly referred to as the board side thereof.

Similarly, where a spiral coil carrier is used instead of a base fabric 32, one of its two sides is sealed with a layer 80 of polymeric resin material, which renders the corrugator belt impermeable. In the actual use of such a corrugator belt on a corrugator machine, the layer of polymeric resin material is disposed on the inside of the endless-loop form thereof.

The layer 80 of polymeric resin material may be provided in one of several ways. In one method, a coating of polymeric resin material is applied to the back side of the belt 30 to provide layer 80. Preferred formulations of the coating material include polyurethane and are applied in the form of an aqueous dispersion thereof.

In another method, a film of polymeric resin material is laminated directly to the back side of the belt 30. Films of polyethylene, polypropylene, polyamide, polyurethane, polyvinyl chloride (PVC) and ionomer resins sold under the trademark SURLYN® may be used to provide layer 80.

Layer 80 may also be provided by powder coating, wherein a layer of meltable thermoplastic powder or fibers is applied to the back side of the belt 30 and melted to produce an impermeable layer 80. A polyamide coating layer 80 can be applied in this manner.

Modifications to the invention described above would be obvious to those of ordinary skill in the art, yet would not bring the invention so modified beyond the scope of the appended claims.

What is claimed is:

1. In a corrugator machine comprising air bearings which direct a high-velocity flow of air against the inside of a corrugator belt thereby forcing said belt toward hot plates on said corrugator machine, the improvement comprising an impermeable corrugator belt, said impermeable corrugator belt comprising:

a base in the form of an endless loop having an inside and an outside; and a layer of a polymeric resin material on said inside of said base, said layer of polymeric resin material being impermeable to air so as to seal said corrugator belt to prevent the passage of said high-velocity flow of air therethrough, whereby said high-velocity flow of air does not cause slippage between said belt and corrugated box board being manufactured on said corrugator machine by joining a corrugated layer to an uncorrugated layer with an adhesive.

2. The improvement as claimed in claim 1 wherein said base is a multi-layer base fabric having a plurality of layers of weft yarns and a plurality of systems of warp yarns, each of said systems weaving between said weft yarns of two adjacent lasers of said plurality of layers, so that all of said plurality of layers of weft yarns are joined together into said base fabric.

3. The improvement as claimed in claim 1 wherein said base is a spiral coil carrier including a plurality of hinge yarns, all of said hinge yarns extending in a common direction, and a plurality of spiral coils disposed in a common plane in a side-by-side relationship, each of said spiral coils extending in a common direction and adjacent spiral coils being intermeshed with one another and held together in intermeshing relationship by at least one of said hinge yarns.

4. The improvement as claimed in claim 1 further comprising a web of staple fiber material needled into at least one of said inside and said outside of said base.

5. The improvement as claimed in claim 1 wherein said layer of polymeric resin material is a coating thereof on said inside of said base.

6. The improvement as claimed in claim 5 wherein said coating includes polyurethane.

7. The improvement as claimed in claim 1 wherein said layer of polymeric resin material is a film thereof laminated onto said inside of said base.

8. The improvement as claimed in claim 7 wherein said film is of a polymeric resin material selected from the group consisting of polyethylene, polypropylene, polyamide, polyurethane, polyvinyl chloride and ionomer resins.

9. The improvement as claimed in claim 1 wherein said layer of polymeric resin material is of melted thermoplastic material.

10. The improvement claimed in claim 9 wherein said thermoplastic material is polyamide.

* * * * *